US005099284A

United States Patent [19]

Ng

[11] Patent Number: 5,099,284

[45] Date of Patent: Mar. 24, 1992

[54] MASTER SHEET AND DRUM ASSEMBLY

[75] Inventor: Yee S. Ng, Fairport, N.Y.

[73] Assignee: Eastman Kodak Company, Rochester, N.Y.

[21] Appl. No.: 399,042

[22] Filed: Aug. 28, 1989

[51] Int. Cl.[5] ..... G03G 15/04

[52] U.S. Cl. ..... 355/242; 430/5; 430/49; 430/56; 430/62; 355/210

[58] Field of Search ..... 355/242, 104, 117, 210, 355/211, 212; 430/62, 63, 49, 5, 56; 118/647

[56] References Cited

U.S. PATENT DOCUMENTS

| | | | |
|---|---|---|---|
| 2,576,047 | 11/1951 | Schaffert | 101/426 |
| 3,515,584 | 6/1970 | Yang | 117/212 |
| 3,615,128 | 10/1971 | Bhagat | 355/3 |
| 3,642,368 | 2/1972 | Moss | 355/47 |
| 3,784,398 | 1/1974 | Metcalfe et al. | 117/17.5 |
| 3,893,762 | 7/1975 | Inagaki | 355/12 |
| 3,954,463 | 5/1976 | Bhagat | 96/1.4 |
| 4,047,945 | 9/1977 | Pfister et al. | 96/1 R |
| 4,078.927 | 3/1978 | Amidon et al. | 430/49 X |
| 4,120,720 | 10/1978 | Gross | 430/62 |
| 4,167,326 | 9/1979 | Payne | 355/16 |
| 4,256,820 | 3/1981 | Landa | 430/54 |
| 4,278,884 | 7/1981 | Landa | 118/647 X |
| 4,298,278 | 11/1981 | Katakura et al. | 355/104 X |
| 4,362,764 | 12/1982 | Matkan et al. | 430/49 X |
| 4,374,916 | 2/1983 | Lelental et al. | 430/62 X |
| 4,522,484 | 6/1985 | Landa | 118/647 X |
| 4,637,709 | 1/1987 | Shirai | 355/3 R |
| 4,664,500 | 5/1987 | Kohler et al. | 355/3 TE |
| 4,868,081 | 9/1989 | Cairncross | 430/49 X |
| 4,888,266 | 12/1989 | Lacolte et al. | 430/5 X |
| 4,937,162 | 6/1990 | Goirand et al. | 430/5 X |

FOREIGN PATENT DOCUMENTS

| | | | |
|---|---|---|---|
| 0236845 | 8/1959 | Australia | 355/242 |
| 3842481 | 6/1989 | Fed. Rep. of Germany | 430/5 |

*Primary Examiner*—Arthur T. Grimley
*Assistant Examiner*—Thu A. Dang
*Attorney, Agent, or Firm*—David A. Howley

[57] ABSTRACT

A master sheet for use in reproducing an original image in a xeroprinting system comprises a transparent supporting dielectric layer, a photoconductive layer, a transparent conductive layer between the dielectric and photoconductive layers, and a mask of opaque material deposited upon the exposed face of the dielectric layer in a predetermined pattern according to the original image. Exposure of the photoconductive layer to light directed through the mask causes a latent image to be formed on the master sheet. A xeroprinting drum assembly for use in a xeroprinting system is also provided wherein a rotatable support drum is wrapped with an electroluminescent (EL) sheet and then the master sheet. The drum assembly may be rotated while the EL sheet selectively exposes the photoconductive layer to provide a latent image. Alternatively, a slit light source may be used.

13 Claims, 4 Drawing Sheets

MASTER SHEET AND DRUM ASSEMBLY

BACKGROUND OF THE INVENTION

1. Field of the Invention

This invention relates generally to xerographic high-speed printing, or xeroprinting, and specifically to a novel xeroprinting master sheet and drum assembly for use in a xeroprinting system.

2. Description of the Prior Art

Xeroprinting, as described by R. M. Schaffert in *Electrophotography* (1980), at p. 209, is an electrostatic printing process designed to print many copies of a subject, document or page from a master plate. The principle of operation, using a master plate formed as a master cylinder, is shown in FIG. 1. The master cylinder typically consists of a conductive substrate, such as a metal sheet or cylinder, upon which is imprinted an image in the form of an insulating coating by conventional photomechanical methods. The image areas consist of insulating material and the background areas are the surface of the bare substrate.

The xeroprinting master is mounted in a xeroprinting engine so as to be rotated past a series of xeroprinter subassemblies, or stations. When the master is electrically charged by passing it under a corona discharge wire, the charges deposited on an insulated image area remain on the image surface and those deposited on the bare metal areas are conducted away to ground. Thus an electrostatic image corresponding to the insulated areas is formed. Thereafter, the making of a print follows a sequence of steps well-known in xerography; e.g., the image is developed with a pigmented powder (toner) and transferred to a receiver, typically paper.

U.S. Pat. No. 2,576,047, to R. M. Schaffert, provides another description of the xeroprinting process. Initially, the master plate is formed as a drum having a grounded, conductive substrate. A developed, insulating primary toner image is transferred and fused to the electrically conductive plate. The plate is charged and whereas the untoned background areas retain no charge, a charge remains on the plate surface in the toned portions. The electrostatic charge pattern, or latent image, can then be developed with a secondary toner and transferred to a suitable receiver for fusing thereto. The drum is then cleaned, and the recharge, and development, and image transfer process is repeated to successive receivers.

A method is disclosed for electrostatic printing in U.S. Pat. Nos. 3,954,463, and 3,615,128, issued to Bhagat. The method includes charging a photosensitive plate and exposing it to an optical pattern to form a latent image; placing the plate on a conveyor; developing the latent image and affixing (fusing) the developed image to the plate to form a xeroprinting master; the aforementioned xerographic steps are utilized as a continuous printing operation to charge and develop the plate, as described by Schaffert. The unfused secondary toner then can be transferred to a copy sheet or web thereby creating a copy of the master.

In some disclosures in the art of contact printing, an original sheet or master has been illuminated from within the drum.

U.S. Pat. No. 3,642,368, issued to Moss, discloses a cylindrical exposure device wherein a transparent original or master sheet is attached to the outside of a drum which has internally rotating slit light sources. A light sensitized plate, attached to the exterior of the drum, is exposed and then removed to be developed in a separate apparatus.

U.S. Pat. No. 4,167,326, issued to Payne, discloses a contact photocopying process and apparatus wherein no master is used. A drum of translucent material has an internal light source which illuminates the rear of a reversed document or original. The illuminated print simultaneously contacts a charged sensitized paper at the nip between the drum exterior and another drum. The latent (correct) image on the sensitized paper is developed and the paper is removed.

U.S. Pat. No. 3,893,762, issued to Inagaki, discloses a master paper winding drum which includes a drum having a resilient layer and a flexible electrically conductive outer layer.

However, the objective in xeroprinting is the production of a relatively large number of copies of a single original. This objective is best accomplished by the use of a master generated from the original, rather than by pursuing the direct reproduction of the original. Some xeroprinting masters that have been created according to the prior art require substantial manufacturing processes and expense. For example, some xeroprinting masters are constructed of materials that retain a master image by forming image-wise patterns in a photoconductor film composition after exposure to a high level ultraviolet-light image. Such a master and the related exposure apparatus system may increase the cost and complexity to the system.

During development of the xeroprinting master, the charged secondary toner particles are electrostatically attracted to oppositely-charged image areas (which are made up of fused primary toner particles). Since there is no charge on the background areas, no attraction of toner particles to the background areas would be expected. In practice, however, Van der Waals forces cause some toner particles to mechanically adhere to the uncharged background areas, and the unwanted residual toner eventually transfers to the receiver. This tends to create an undesired background coloration in the developed image. The master must therefore subjected to a cleaning process after each secondary toner transfer to remove residual toner remaining on background areas of the surface. This is especially important with respect to a xeroprinting master, as compared to xerographic copiers in general, since a build-up of background toner will occur rapidly in a machine operating at high speed. Proper cleaning of the master is thereby crucial to good xeroprinting.

Consequently, the cleaning methods and apparatus in the prior art must at times be so thorough that the master surface is subjected to abrasion or degradation. Accordingly, practitioners of the art have resorted to complicated means for protecting the master. For example, by coating the conductive substrate of a xeroprinting master with a thin layer or coating of a lubricous resin, there is a reduced tendency of secondary toner particles to be retained in background areas during development. The cleaning of residual toner particles from the background areas is then facilitated due to the coating overlying the substrate. However, the apparatus and process for establishing such a coating increases the expense and complexity of those masters. Further, the coating on such a master is itself subject to depletion with concomitant secondary toner adhesion.

Some photosensitive image receptors used in xerography have been known to include protective layers that are transparent and insulative.

U.S. Pat. No. 4,664,500, issued to Kohler et al., discloses a method and apparatus for transferring a latent image from a photosensitive image receptor to a dielectric or insulating image receptor. The photosensitive image receptor comprises a conductive base, a photoconductive layer, and a transparent protective layer.

U.S. Pat. No. 3,784,398, issued to Metcalfe et al., discloses a method and means for transferring recorded signals and latent electrostatic images wherein an insulating medium is placed over the photoconductor surface.

However, these and other efforts evident in the prior art do not fully provide a simplified, abrasion-resistant xeroprinting master for repetitive, extended use in a high-speed xeroprinting engine. There remains the task, at high speed, to clean such a master thoroughly, and yet the primary (fused) toner pattern must not be removed or damaged. Removing the master from the xeroprinter (for cleaning) is also contrary to the basic premise of a high-speed, efficient xeroprinting operation. A master that is simple, efficient, inexpensive, and durable, and which may remain on the xeroprinting engine for extended periods, is therefore needed to realize the advantages of the xeroprinting process that was envisioned by Schaffert.

There is also a need for a xeroprinting master that may be formed from conventional materials into a film of simple structure. A large number of blank masters could be fabricated and subsequently provided with a master image by processing it in a master-making reprographic apparatus using conventional xerographic techniques.

SUMMARY OF THE INVENTION

It is an object therefore of the invention to provide a method and apparatus for correcting the above-described difficulties in accomplishing high-speed xeroprinting.

In accordance with the invention, a master sheet is provided for use in reproducing an original image in a xeroprinting system. The master sheet comprises a transparent supporting dielectric layer, a photoconductive layer, a transparent conductive layer between the dielectric and photoconductive layers, and a mask of light-opaque material deposited upon the dielectric layer in a predetermined pattern according to the original image. The mask may be used to selectively admit light to the dielectric and conductive layers for further transmission to the photoconductive layer to provide an imagewise pattern of conductivity therein.

In another embodiment of the invention, there is provided a master drum assembly for use in a xeroprinting system to reproduce an original image. The master drum assembly includes the aforementioned master sheet mounted upon a rotatable support drum having an inner and a outer surface and an electroluminescent (EL) sheet fixed upon the outer drum surface. The EL sheet includes a plurality of addressable electroluminescent panels therein that selectively emit light to the mask.

In an alternative embodiment of the invention, there is provided a master drum assembly which includes the aforementioned master sheet and further comprises a rotatable support drum having an inner and an outer surface and a slit-light source positioned within the inner drum surface operable to selectively emit light onto a portion of the master sheet.

A further embodiment of the invention provides a xeroprinting system for the reproduction of an original image on a receiver, comprising a xeroprinting drum assembly with an EL sheet as described above, and a plurality of electrophotographic process stations for engaging the drum assembly, whereby rotation of the master drum assembly and selective operation of the EL sheet and the process stations provide a developed, transferable image.

A method of xeroprinting is also provided which comprises the steps of rotating a xeroprinting master sheet as described above, uniformly charging the photoconductive layer, illuminating portions of the mask so as to selectively expose sequential portions of the photoconductive layer to provide therein discharged areas that form a latent image at the outer face, developing the latent image with pigmented marking particles, transferring the developed image to a receiver, and fixing the transferred image.

BRIEF DESCRIPTION OF THE DRAWINGS

In the detailed description of the preferred embodiments of the invention presented below, reference is made to the accompanying drawings, in which.

The invention, and its objects and advantages, will become more apparent in the detailed description of the preferred embodiments presented below.

DETAILED DESCRIPTION OF THE DRAWINGS

Figure 1:
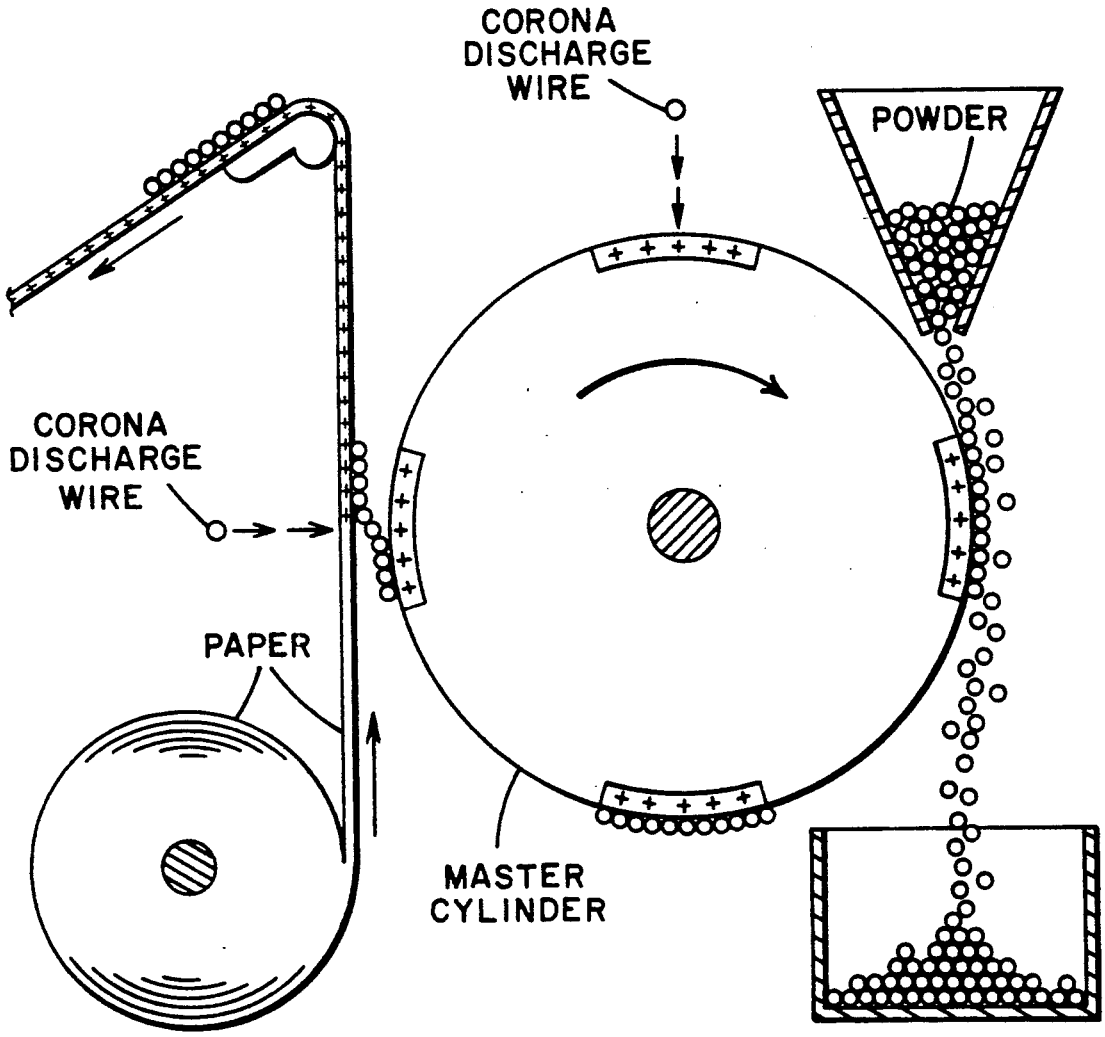
FIG. 1 (PRIOR ART)
FIG. 1 is a side schematic view of a prior art xeroprinting system, with a xeroprinting master formed as a cylinder.
Figure 2:
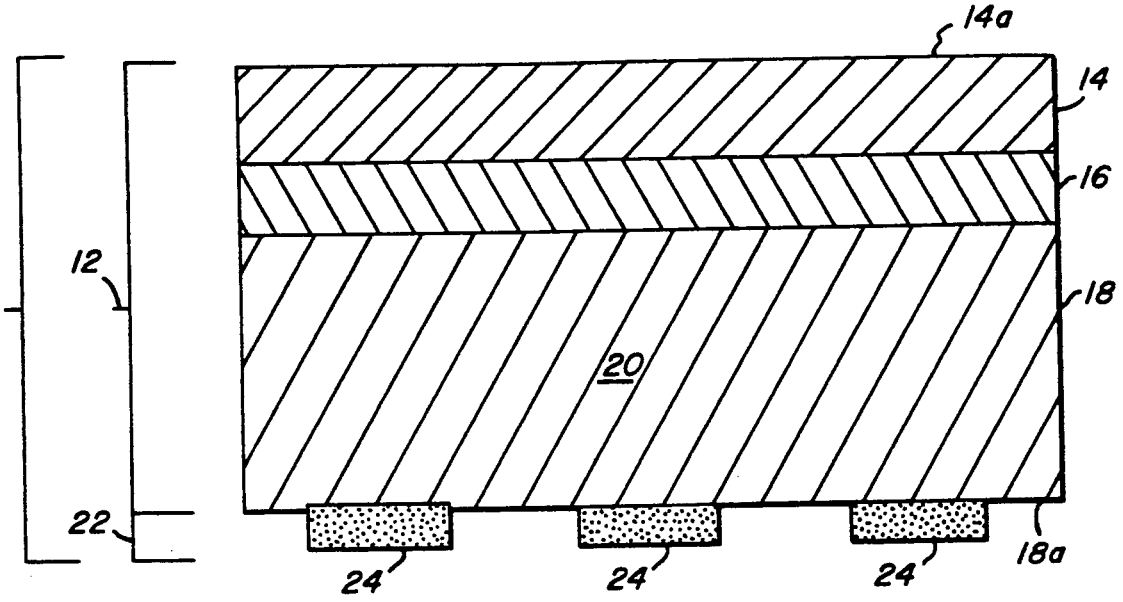
FIG. 2 is a cross-sectional side view of a novel xeroprinting master sheet constructed according to the present invention.

A preferred embodiment of a novel xeroprinting master 10 according to the present invention is illustrated in FIG. 2. A receiver sheet 12, which replaces the conventional xeroprinting master, is provided with a photoconductive layer 14 (which is preferably green sensitive), an intermediate conductive layer 16, and a supporting dielectric layer 18 composed preferably of polycarbonate film base. The receiver sheet is thus a composite structure.

The photoconductive layer 14 has an outer face **14*a* and is composed of a typical photoconductive material such as shown, for example, in U.S. Pat. No. 3,615,41, issued Oct. 26, 1971 in the name of Light. Of course, other organic or inorganic photoconductive materials are suitable for use with this invention. The photoconductive layer 14** may be bipolar and thus may accept a positive or negative charge. After selective exposure to light, a charge pattern is formed on the photoconductive layer for later development with an influx of toner marking particles. An imagewise pattern (latent image) is formed by discharging either that portion of the image corresponding to the information content to be reproduced or by discharging the areas which correspond to the image background.

The dielectric layer 18 is preferably composed of a flexible transparent material that allows optical transmission of light without inducing significant aberration. The dielectric layer 18 also is preferably composed of a material having good dimensional and thermal stability, such as KODAK ESTAR film base. The conductive layer 16 is preferably composed of a layer of flexible conductive material.

The receiver sheet 12 is further prepared by depositing an imagewise master information pattern, or mask 22, onto the inner face 18*a* of the dielectric layer 18. The receiver sheet is preferably processed such that the mask 22 is composed of a primary toner image 24 with 7μ toners. The mask-depositing apparatus may be in particular an electrophotographic apparatus. Such an apparatus would generate a mask by transferring a predetermined imagewise toner pattern 24 to the inner face 18*a* of the receiver sheet 12. This primary toner image 24 is developed from pigmented marking particles that are transferred to the receiver sheet 12 and permanently fixed to the sheet by heat and/or pressure to form the desired mask 22.

Moreover, modifications of the above-described mask deposition are contemplated as including a variety of other material transfer methods, such as by xerographic, electrographic, ink jet, and thermal (ablative) transfer imaging processes. Accordingly, other variable-density masking materials may be deposited on the inner face 18*a* in an imagewise pattern to provide a mask 22.

The mask 22 in the preferred embodiment has been termed a primary toner image 24 so as to distinguish it from a secondary toner deposition process to be described shortly. The primary toner is, nonetheless, preferably a conventional formulation that need only be suited for electrostatic transfer and fusing to the dielectric layer 18. The receiver sheet, having been developed and fixed to include the mask 22 thereon, is then considered to be a master sheet 26.

Figure 3:
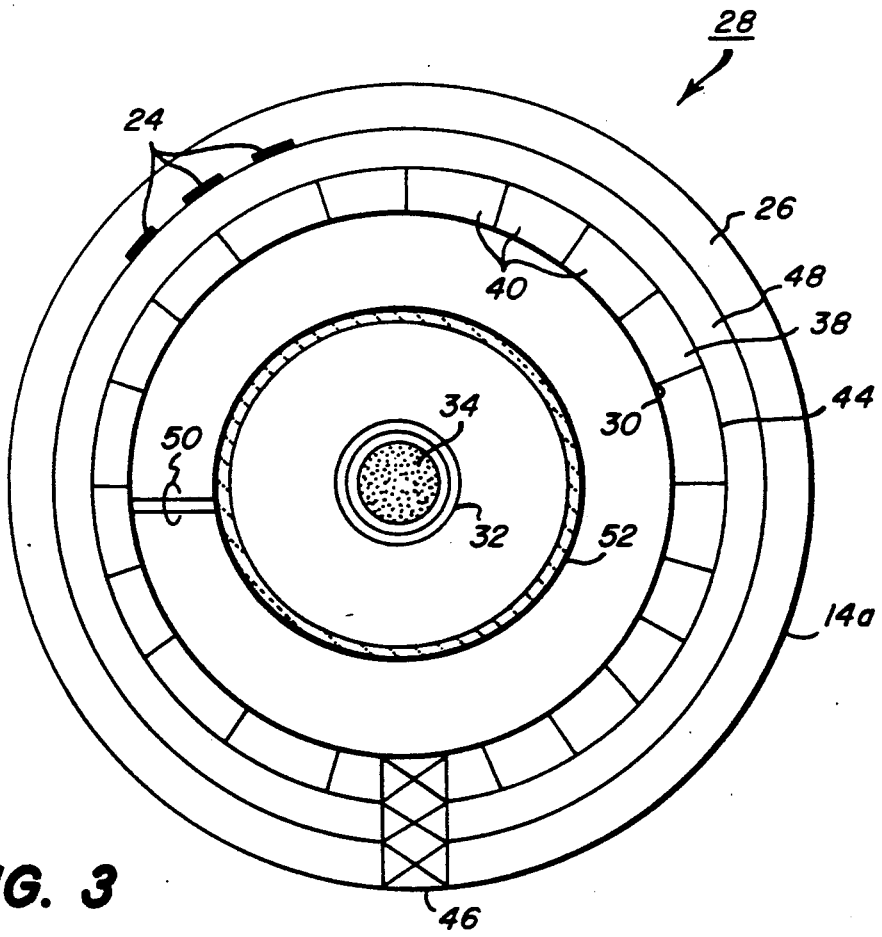
FIG. 3 is a cross-sectional side view of a xeroprinting master drum assembly that includes the master sheet of FIG. 2.

A novel xeroprinting drum assembly 28, suitable for use in a high-speed xeroprinting engine, incorporates the master sheet 26 as shown in FIG. 3. At the core of the multi-layered drum assembly 28 is a support drum 30 which includes an inner sleeve 32 for engaging a complementary axle 34. The master drum is thus mountable upon the axle 34 and is rotated by any of a variety of known drive means (not shown.)

A flexible, lightweight electroluminescent (EL) member, or EL sheet 38, is wrapped around the support drum. The EL sheet 38 is composed of a number of addressable segments, or EL panels 40, which, when activated in groups according to a predetermined sequence, will emit a band of light from a lightemitting face 44 of the EL sheet. The underside (mounting face) of the EL sheet 38 is attached to the drum using an adhesive which retains the EL sheet 38 at high rotational speeds without it being shifted or distorted. The EL sheet conforms to the support drum 30 such that the emitting face 44 is similarly cylindrical and substantially smooth. A sheet gripping mechanism 46 clamps against the EL sheet ends and also accepts the ends of the master sheet as it is wrapped over the EL sheet and onto the support drum. An optional transparent smoothing film 48 may be included under the master sheet to compensate for any discontinuities and other surface irregularities that may exist on the surface of the EL sheet 38. Additionally, because the light emitted from the EL sheet originates from a plurality of the EL panels 40 that may be individually separated by a small gap, the smoothing film 48 also diffuses the light from the edges of each active (i.e., light-emitting) panel.

The developed master sheet 26 is positioned with the mask 22 facing the EL sheet 38. The outer face 14*a* of the photoconductive layer thus becomes the outer surface of the drum assembly 28. The primary toner image 24 is therefore protected from abrasion and other degradation by the master sheet 26. If the drum circumference is such that the primary toner image 24 does not completely cover the circumferential area of the drum assembly 28, then the multiple panel portion of the EL sheet 38 can be smaller and only cover a corresponding portion of the support drum. Alternatively, one master sheet may include a more than one toner image 24, wherein each image is an individual mask 22, and the master sheet is wrapped on a correspondingly sized EL sheet 38. Given a constant speed of drum rotation, the reproduction capability of such multi-image embodiment is increased according to the number of images included on the circumference of the drum assembly 28.

Electrical conductors 50 for carrying the requisite power and ground signals to the EL sheet 38 are directed to a set of conductive tracks 52 that are formed on the inner surface 54 of the support drum. As is known in the art of rotating electrical machinery, these signals are supplied to the conductive tracks 52 by stationary conductive brushes (not shown). Other power interconnection means, as are generally known in that art, are suitable as well.

Each panel 40 thus is activated by switching its respective power conductor from ground potential to an activation voltage level. The panel 40 may be deactivated by reversing this process. Hence, the panels may be sequentially activated and extinguished by a conventional switching means provided in a logic and control unit (not shown).

The master sheet 26 is thus simple to manufacture, easy to install, and highly resistant to image degradation such that a greater number of reproductions may be generated, even at high-speed, before the master must be replaced. Additionally, by including the master sheet 26 on the novel drum assembly 28, the master drum assembly may be installed, operated, and removed from a xeroprinting engine with little or no "down-time" for adjustment and replacement. A xeroprinting system, which integrates the drum assembly in a system of charging, development, transfer, and fixing stations, then offers significant performance at improved economy because the per-unit cost of each reproduction is greatly reduced.

Figure 4:
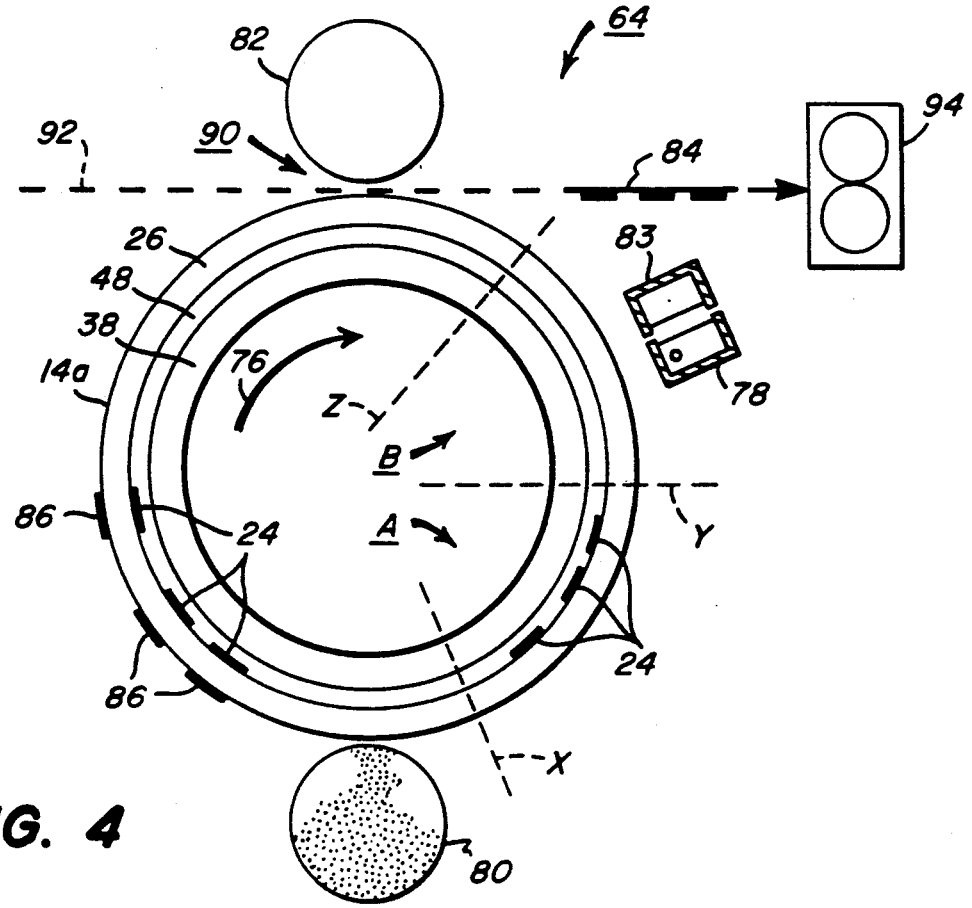
FIG. 4 is a cross-sectional and schematic side view of a single color xeroprinting system which incorporates the master drum assembly of FIG. 3.
Figure 5:
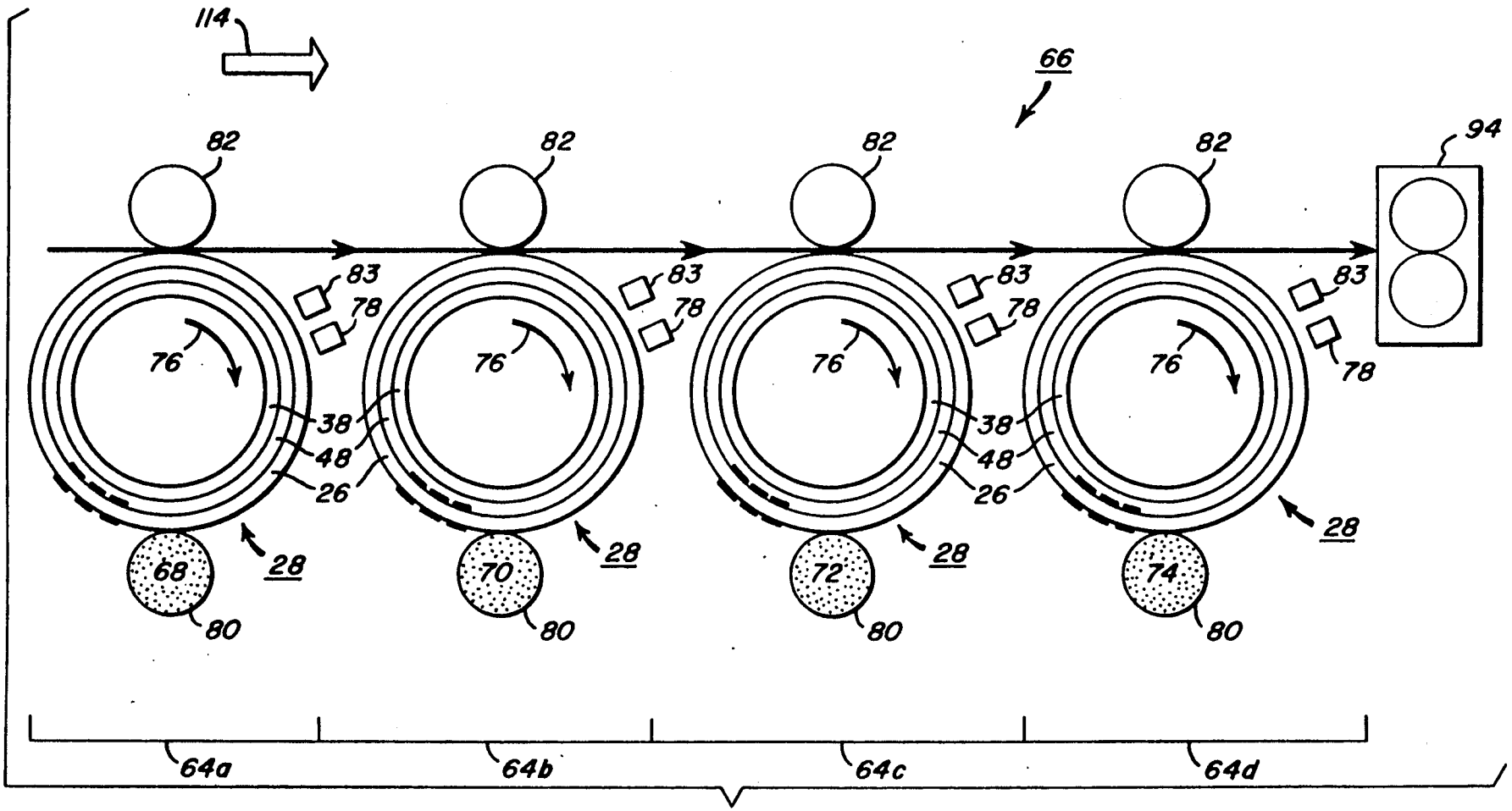
FIG. 5 is a cross-sectional and schematic side view of a multicolor xeroprinting system using a multiplicity of the master drum assembly of FIG. 3.

A preferred embodiment of an improved xeroprinting system is shown in FIGS. 4 and 5. In FIG. 4, one xeroprinting master drum assembly 28 is used in a single color system 64. In FIG. 5, a multicolor system 66 is contemplated as employing one xeroprinting master drum assembly for each of the colors, i.e., cyan 68, magenta 70, yellow 72, and black 74 for printing each color of a composite print.

In the single-color system, rotation 76 of the drum causes any one part of the photoconductive layer 14 to pass sequentially under a corona charger 78, a development station 80, and a transfer drum 82, and a cleaning station 83. Continuous rotation in the direction indicated by arrow 76 allows the photoconductive layer to respectively undergo repeated operations of charging, exposure, development, transfer, and developer (toner) cleaning.

Firstly, a uniform electrostatic charge is deposited upon the photoconductive layer by corona charger 78. Then segments of the EL panel located between the charger and the development station 80 are illuminated. By controlling the address of the activated EL panels 40, the characteristic, or profile, of the light exposure may be set. The preferred profile is provided by sequentially controlling the activation time and period of illumination of each EL panel so as to sweep a band of light around the circumference of the drum assembly. The activation of each of the EL panels is thus timed at a predetermined period so as to cycle through all the panels in a uniform and precise fashion. Each panel 40 is activated for a discrete $t_{on}$ period and then extinguished until reactivation is needed after a timed delay. By sequencing the activation time for adjacent panels, the band of light sweeps the drum at a rate that is equal and opposite to the rotation rate and direction 76, respectively, of the drum assembly. The result is such that the band of light appears stationary while the drum assembly is rotating. Other illumination profiles are possible depending upon the rate, period, and sequence of panel illumination desired.

An electrostatic latent image is then formed on the surface of the photoconductive layer 14 by this exposure of the charged master sheet 26 to light from the activated EL panels 40 in the EL sheet. Only the light that is not obscured in an imagewise pattern by the mask 22 reaches the photoconductive layer. The charge at the exposed areas is conducted through the photoconductive layer 14 to the conductive layer 16 to be dissipated to a lower, or preferably ground-level, potential. The discharge thus corresponds to the amount and location of illumination. Thus, the latent electrostatic image is available on the surface of photoconductive layer 14, which is also the outer surface of the drum assembly 28.

With the continued rotation of the drum assembly, the electrostatic latent image is developed by the development station 80 and the developed image is transferred at a transfer drum onto a receiver 84. The latent image is preferably developed with a secondary toner 86 which has the same polarity as the polarity of the deposited charge that forms the latent image. The toner particles deposit in the discharged areas to develop a negative image of that present on the mask. The development station and transfer drum operate in a conventional manner to provide the creation and transfer, respectively, of a secondary toned image 88 from the drum assembly to the receiver. As is known, the transfer drum may be charged to a polarity to attract the toner image to the receiver 84. Alternatively, a positive image of the mask may be made by having the secondary toner particles be of the opposite polarity as the charge on the photoconductive layer.

The receiver 84 is introduced along a path 92 and engages the transfer drum 82 and the drum assembly at a nip 90 in the receiver path 92 where the receiver 84 meets the photoconductive layer 14. The receiver 84 moves in the same direction and rate as the rotation 76 of the drum assembly 28 and transfer drum 82. Continued rotation, along with the pressure at the nip between the drum assembly and the transfer drum, causes the secondary toned image to be transferred to the receiver. The receiver continues to a fuser 94 for fixing the transferred image. Accordingly, a xeroprinted reproduction of the master image, as the fuser secondary toner image 96 on the receiver, may be accomplished successfully at high speed.

As shown in FIG. 5, a multicolor xeroprinting system may be constructed from a succession 114 of single color xeroprinting systems 64, 64*a*, 64*b*, 64*c*, 64*d* along a multicolor processing path 116. By providing a controlled uniform rotation of each drum assembly 28, a secondary toned image 88 at each single color system is transferred to the receiver 84 in register with the preceding secondary toned image 88. Because each single color system 64 incorporates a differing color of secondary toner in its development station 80, each secondary toned image 88 is a respective reproduction of a color separation image. Of course, the image found in each mask 22 comprises a color separation image for the image being reproduced. The end result is a developed multicolor composite image on the receiver. The composite image is then fixed at a fuser 94 which is situated at the end of the multicolor processing path, rather than at each single color system as was described with reference to FIG. 4.

Figure 6:
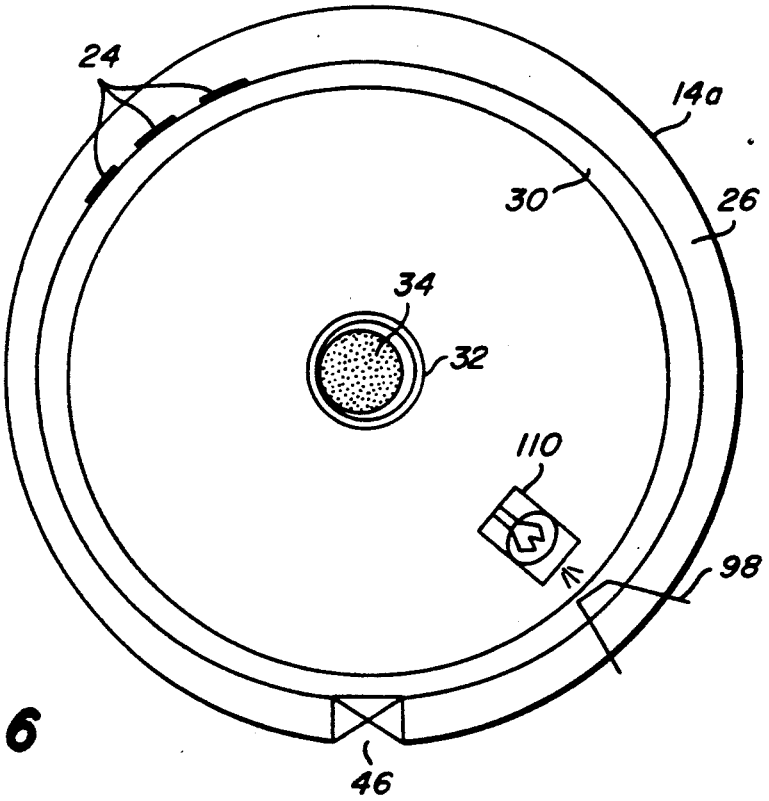
FIG. 6 is a cross-sectional side view of an alternative embodiment of the master drum assembly of FIG. 3.

An alternative design for the xeroprinting drum is shown in FIG. 6. The support drum 30 is constructed of a transparent material and is configured for rotation around a slit light source or lamp 110 that projects a band of light through the drum. As the drum is rotated about its axle 34 the slit light source illuminates the support drum in a fashion similar to the above-mentioned sequential illumination provided by the EL sheet. The slit lamp is preferably stationary and thus provides a similarly fixed band of light 98.

The illumination profile from the EL panels or the slit light source may be adjusted according to the speed and exposure level required by the xeroprinting system. The profile may be set in accordance with the characteristics of the photoconductive layer and the image qualities (contrast, density, etc.) required of the reproduction. For example, with reference to FIG. 4, assume that segment A of the drum assembly 28 occupies the portion of the circumference of the drum assembly from point X to point Y. As point X passes the corona charger, the area of the photoconductive layer 14 above segment A is charged. After point Y passes the charger, the EL panels 40 in segment A are activated and they expose the corresponding portion of the photoconductive layer through the mask 22. The panels at segment A are deactivated before point X arrives at the position of the development station 80. In the mean time, segment B (which occupies the drum assembly circumference from point Y to point Z) is being charged. When point Z passes the corona charger 78, the EL panels 40 in segment B are activated. The electrostatic latent image in segment A is developed with secondary toner as it is advanced past the transfer drum 82. Segment B thus will follow segment A past the development station 80 and to the transfer drum 82.

The invention has been described in detail with particular reference to preferred embodiments thereof, but it will be understood that variations and modifications can be effected within the spirit and scope of the invention.

What is claimed is:

1. A master sheet for use in reproducing an original image in a xeroprinting system, comprising:

a transparent supporting dielectric layer;
a photoconductive layer;
a transparent conductive layer between the dielectric and photoconductive layers; and
a mask comprising light-opaque material on the dielectric layer in a predetermined pattern according to the original image.

2. A master sheet as claimed in claim 1 wherein the opaque material is a pigmented marking material.

3. A master drum assembly for use in reproducing an original image in a xeroprinting system, comprising:
a support drum;
an electroluminescent (EL) sheet fixable to the outer drum surface having a plurality of addressable electroluminescent panels that selectively emit light; and
a master sheet comprising:
a. a transparent supporting dielectric layer having an inner face attachable to the EL sheet,
b. a mask of light-opaque material deposited on the dielectric layer in a predetermined pattern according to the original image,
c. a photoconductive layer having an outer face, and
d. a transparent conductive layer between the dielectric and photoconductive layers;
whereby a latent image may be provided at the photoconductive layer by charging same and sequentially activating the EL sheet panels.

4. A master drum assembly as claimed in claim 3 wherein the opaque material is a pigmented marking material.

5. A master drum assembly as claimed in claim 3 wherein the EL sheet and the master sheet are retained on the support drum by a sheet gripping mechanism fixed thereon.

6. A master drum assembly as claimed in claim 3 further comprising a transparent smoothing film positioned between the EL sheet and the master sheet.

7. A master drum assembly for use in reproducing an original image in a xeroprinting system, comprising:
a transparent support drum;
a master sheet comprising:
a. a transparent supporting dielectric layer having an inner face attachable to the support drum,
b. a mask of light-opaque material deposited on the dielectric layer in a predetermined pattern according to the original image,
c. a photoconductive layer, and
d. a transparent conductive layer between the dielectric and photoconductive layers; and
a slit-light source positioned within the drum for selectively exposing a portion of the master sheet;
whereby a latent image may be provided at the photoconductive layer by charging same and activating the slit-light source.

8. A master drum assembly as claimed in claim 7 wherein the opaque material is a pigmented marking material.

9. A master drum assembly as claimed in claim 7 wherein the master sheet is retained on the support drum by a sheet gripping mechanism.

10. A xeroprinting system for the reproduction of an original image, comprising:
a master drum assembly, comprising:
a. a rotatable support drum;
b. an electroluminescent (EL) sheet fixable to the support drum and having a plurality of addressable EL panels that selectively emit light from a light-emitting face; and
c. a xeroprinting master sheet attachable to the light-emitting face of the EL sheet and having a transparent supporting dielectric layer, a mask of light-opaque material deposited on the dielectric layer in a predetermined pattern according to the original image, a photoconductive layer, and a transparent conductive layer between the dielectric and photoconductive layers;
and a plurality of electrophotographic process stations for engaging the master drum assembly, comprising a charger, a development station, a transfer station, and a cleaning station;
whereby rotation of the master drum assembly and selective operation of the EL panels and the process stations provide a developed, transferable image at the photoconductive layer.

11. A xeroprinting system as claimed in claim 10, comprising a successive plurality of master drum assemblies and corresponding process stations, each development station providing pigmented marking particles of a particular color, whereby a respectively-colored transferable image may be developed at each respective photoconductive layer.

12. A method of making a master sheet for use in xeroprinting, comprising the steps of:
providing a receiver sheet having a transparent supporting dielectric layer, a photoconductive layer, and a transparent conductive layer between the dielectric and photoconductive layers;
forming a primary toner image;
transferring the primary toner image to the dielectric layer; and
fusing the transferred image to the dielectric layer.

13. A method of xeroprinting to provide a reproduction of an original image, comprising the steps of:
providing a master sheet comprising a transparent supporting dielectric layer, a photoconductive layer, and a transparent conductive layer disposed between the dielectric and photoconductive layers, said dielectric layer having a mask of light-opaque material in a predetermined pattern corresponding to the original image disposed thereon;
uniformly charging the photoconductive layer;
illuminating the photoconductive layer through the mask to discharge corresponding areas of the photoconductive layer to form a latent image;
developing the latent image with pigmented marking particles;
transferring the developed image to a receiver; and
fusing the transferred image to the receiver.

* * * * *